US006094016A

United States Patent [19]

Luger et al.

[11] Patent Number: 6,094,016

[45] Date of Patent: Jul. 25, 2000

[54] ELECTRONIC BALLAST

[75] Inventors: Siegfried Luger; Alfred Tröstl; Christian Söhnel, all of Dornbirn, Austria

[73] Assignee: Tridonic Bauelemente GmbH, Dornbirn, Austria

[21] Appl. No.: 09/387,565

[22] Filed: Sep. 1, 1999

Related U.S. Application Data

[63] Continuation of application No. PCT/EP98/00879, Feb. 16, 1998.

[30] Foreign Application Priority Data

Mar. 4, 1997 [DE] Germany ..... 197 08 784
Dec. 22, 1997 [DE] Germany ..... 197 57 295

[51] Int. Cl.[7] ..... G05F 1/00

[52] U.S. Cl. ..... 315/295; 315/308; 315/362; 315/149; 315/151

[58] Field of Search ..... 315/291, 294, 315/295, 297, 307, 308, 362, 149, 151, 157, 159, 209 R, DIG. 4; 250/214.1, 214 AL, 227.14

[56] References Cited

U.S. PATENT DOCUMENTS

| | | | |
|---|---|---|---|
| 3,274,392 | 9/1966 | Harling | 250/227 |
| 4,383,288 | 5/1983 | Hess, II et al. | 362/32 |
| 4,701,669 | 10/1987 | Head et al. | 315/155 |
| 4,703,173 | 10/1987 | Wood et al. | 250/227 |
| 4,874,989 | 10/1989 | Nilssen | 315/151 |
| 5,250,799 | 10/1993 | Werner | 250/214 |
| 5,404,080 | 4/1995 | Quazi | 315/151 |
| 5,493,181 | 2/1996 | Shackle et al. | 315/241 |
| 5,701,058 | 12/1997 | Roth | 315/158 |

FOREIGN PATENT DOCUMENTS

| | | |
|---|---|---|
| 0410484A1 | 1/1991 | European Pat. Off. . |
| 0689373A2 | 12/1995 | European Pat. Off. . |
| 2262794A | 9/1975 | France . |

*Primary Examiner*—Haissa Philogene
*Attorney, Agent, or Firm*—Fitzpatrick, Cella, Harper & Scinto

[57] ABSTRACT

An electronic ballast (EVG) is provided for operating at least one lamp (10), wherein a light sensor (20) for monitoring the brightness of a specific physical area (28) can be connected to the electronic ballast. A control arrangement (12) controls or regulates the brightness of the lamp (10) as a function of an actual brightness value delivered by the light sensor (20) and when the electronic ballast is put into operation automatically identifies whether a light sensor (20) is connected to the connection arrangement (18*a*, 18*b*). If no light sensor (20) is connected, the control or regulation of the brightness of the lamp (10) is effected as a function of externally supplied control information

34 Claims, 5 Drawing Sheets

ELECTRONIC BALLAST

CROSS REFERENCE TO RELATED APPLICATIONS

This is a continuation of co-pending International Application No. PCT/EP98/00879, filed Feb. 16, 1998.

BACKGROUND OF THE INVENTION

1. Field of the Invention

The present application relates to an electronic ballast for operating gas discharge lamps, to which a light sensor can be connected for the purpose of monitoring the brightness in a specific physical area, and also to a special development of such a light sensor.

2. Description of the Related Art

It is known that it is possible to sample the brightness of a workplace, for example, with the aid of a light sensor, and by means of the output signal of the light sensor activate a so-called electronic ballast which, as a function of the actual brightness value delivered by the light sensor, generates a corresponding manipulated-variable value for a lamp operated by the electronic ballast. In this connection, for example, a light sensor from the firm of Philips is known that is of an elongated form and which has the internal circuit design shown in FIG. 5. The light sensor comprises a light-sensitive resistor 31 which, in accordance with FIG. 5, is connected up to a diode 32, two resistors 33 and 36, a capacitor 34 and also a transistor 35. An analog output signal is made available at the output terminals 37*a* and 37*b* of the known light sensor, in which case on account of irradiation with differing intensities of light the resistance value of the light-sensitive resistor 31 is varied so that a resistance value, which is dependent upon the light incidence, occurs at the terminals 37*a* and 37*b*.

In the case of the known light sensor, the actual brightness value measured by the light sensor can be varied in that a sleeve, which is impervious to light and is of a different length, is slipped over the elongated sensor and thus—as a function of the length of the sleeve—shades off a portion of the incident light from the light-sensitive resistor 31 to a greater or less extent. By shading off a portion of the incident light, the actual brightness value delivered by the sensor 30 is reduced so that an electronic ballast, which is connected to the light sensor, increases the brightness of a lamp which is arranged at the workplace that is being monitored by the light sensor. On the other hand, by decreasing the extent to which the incident light is shaded off from the light-sensitive resistor 31 of the light sensor 30, the actual brightness value detected by the light sensor 30 is increased so that the corresponding lamp is dimmed by means of the electronic ballast which is connected to the light sensor 30.

As a result of using sleeves of differing lengths, it is thus possible to dim the lamp illuminating the respective workplace. In the case of the known light sensor described above, it is of course necessary for sleeves of various lengths to be kept in readiness, which sleeves can, however, easily get lost.

Furthermore, in the case of the known electronic ballasts the control or regulation of the brightness of the activated lamps with the aid of the actual brightness value delivered by the light sensor, on the one hand, and also as a function of external control information, on the other hand, is problematic, since the known electronic ballasts do not know which control or regulation possibility is to be used to effect the control or regulation of the lamps, if the electronic ballast is designed in such a way that both possibilities exist.

SUMMARY OF THE INVENTION

The underlying object of the invention is therefore to provide an electronic ballast in which a conflict between externally supplied control information and an actual brightness value signal of a light sensor can be reliably avoided.

This object is achieved in accordance with the present invention by means of an electronic ballast for operating at least one lamp and having a connection arrangement to which a light sensor can be connected for the purpose of monitoring the brightness of a specific physical area, and a control arrangement which controls or regulates the brightness of said at least one lamp as a function of an actual brightness value received from a light sensor, said control arrangement being responsive to said electronic ballast being put into operation to indicate whether the light sensor is connected to the connection arrangement. Further; advantageous developments and preferred exemplary embodiments of the present invention.

The electronic ballast proposed in accordance with the invention for operating at least one lamp can be coupled directly with a light sensor so that the actual brightness value delivered by the light sensor can be supplied to a control arrangement, for example a microprocessor, provided in the electronic ballast, which control arrangement in turn as a function of the actual brightness value produces a corresponding manipulated-variable value for a manipulated variable of the electronic ballast for the purpose of dimming the at least one lamp. Moreover, the control arrangement can obtain further external control information for the purpose of dimming the at least one lamp.

The electronic ballast in accordance with the invention when put into operation automatically carries out an examination to determine whether a light sensor is connected or not. This examination is effected in particular by measuring the resistance which occurs at the terminals which are provided for the light sensor. As a result of this examination, the possibility exists of avoiding a conflict as a result of additionally supplied external control signals, since after identifying that a light sensor is connected, for example, priority is always given to the actual brightness value of the light sensor and the lamp brightness can be regulated exclusively as a function of the actual brightness value of the light sensor.

Since the control arrangement is, as a rule, formed by means of a digitally operating microprocessor, the electronic ballast can have an analog-to-digital converter arrangement which converts the analog actual brightness value signal delivered by the light sensor into a corresponding digital signal.

A particularly advantageous feature of the invention involves a light sensor which comprises an optical light-detection means arranged to detect luminous radiation that corresponds to the brightness of a monitored area, and a light-sensitive means located so as to be irradiated by the luminous radiation which is detected by the optical light-detection means and, as a function of the incident luminous radiation, to emit a corresponding signal or to change their physical properties. With the aid of these features, it is possible to vary the actual brightness value determined by the light sensor in that the distance of the optical light-detection means provided in the light sensor from correspondingly provided light-sensitive means is varied. This variation can be effected, for example, with the aid of a screw thread. The optical light-detection means, at the end of which that lies opposite the light-sensitive resistor there may be a convex lens, can be formed of an elongated plexiglass or polycarbonate body, located on the outer surface of which there is a thread which is designed so as to be complementary to an internal thread of the housing. In this way, it is possible for the transparent polycarbonate or plexiglass body to be shifted in relation to the non-transparent housing body, whereby the surface of the polycarbonate or plexiglass body detecting the ambient light can be reduced or increased. In order to guarantee that the light coming from the monitored physical area is only evaluated integrally and that it is not exclusively the point of the monitored area located directly below the tip of the elongated light sensor that is evaluated, this tip of the elongated light sensor can be blacked out, by, for example, adhering patches, which are impervious to light, to the tip.

The invention is described in greater detail in the following with the aid of preferred exemplary embodiments and with reference to the enclosed drawing, in which:

DETAILED DESCRIPTION OF THE PREFERRED EMBODIMENTS

Figure 1:
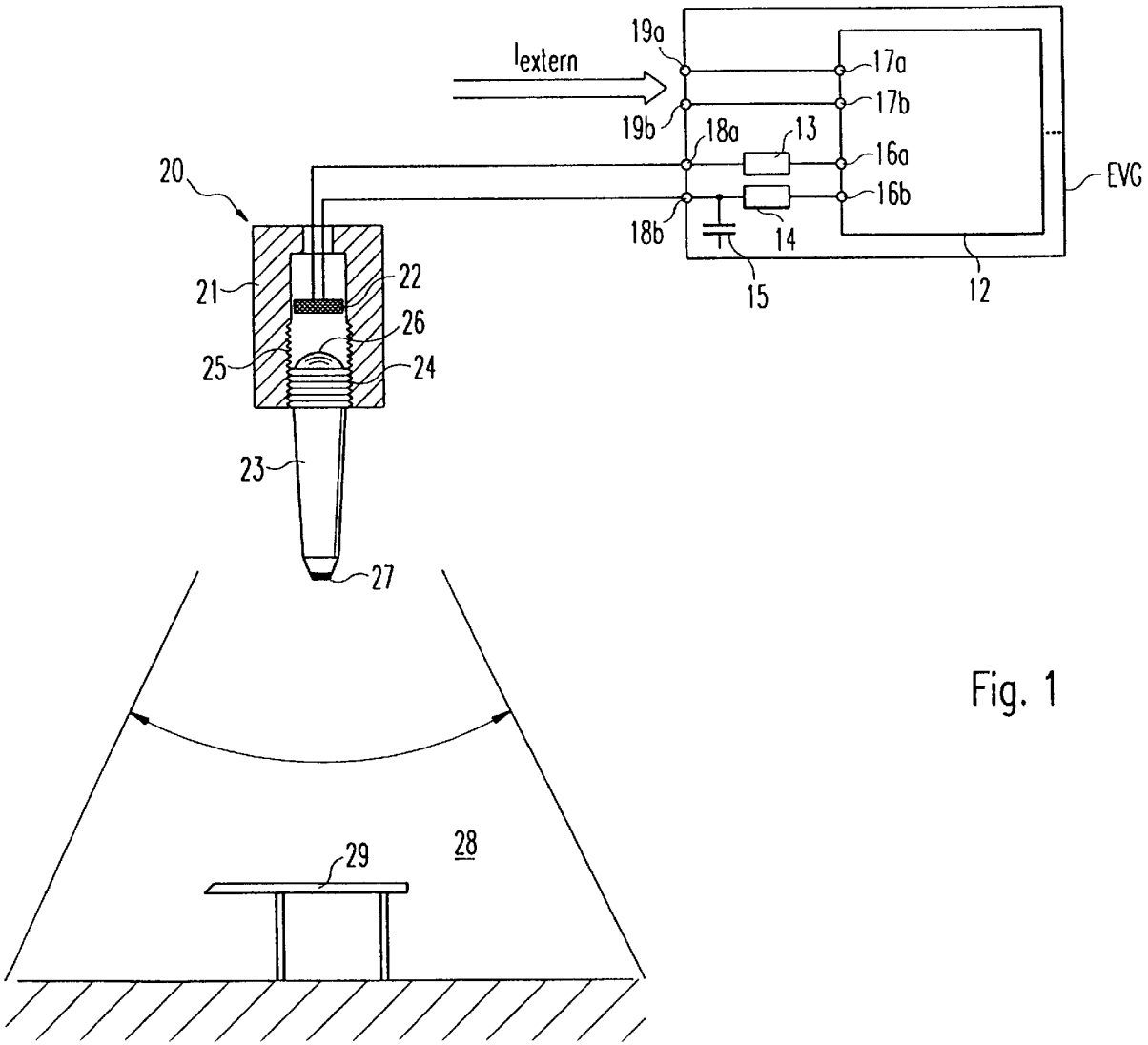
FIG. 1 shows a preferred exemplary embodiment of the light sensor that is preferably used and which is coupled to an electronic ballast in accordance with the present invention.

FIG. 1 shows a cross-sectional view of a preferred exemplary embodiment of a light sensor 20 which is connected to an electronic ballast EVG. The configuration of the light sensor 20 explained in greater detail below is not, however, limited to applications with electronic ballasts in accordance with the invention, but can be used or employed generally wherever the brightness of a specific physical area is to be monitored or detected.

The light sensor 20 in accordance with the invention that is shown in FIG. 1 substantially comprises a light-sensitive resistor 22 and also an optical body 23 which is formed, for example, by means of a transparent polycarbonate or plexiglass body. The optical body 23 and the light-sensitive resistor 22 are arranged inside a housing 21 which is impervious to light, in which case provided on the outer surface of the optical body 23 there is an external thread 24 which is designed so as to be complementary to an internal thread 25 on the inside of the housing 21. The optical body 23 is formed so as to be elongated and slightly conical. The optical body 23 can, however, also be designed so as to be conical towards the external thread 24 or so as to be generally cylindrical. Furthermore, instead of the light-sensitive resistor 22 it is also possible to use a photodiode or similar. Provided at the end of the optical body 23 that lies opposite the light-sensitive resistor 22 there is a convexly shaped lens 26 which is used to concentrate the luminous radiation detected by the optical body 23. The lens 26 irradiates the light-sensitive resistor 22 with the concentrated luminous radiation, whereupon the light-sensitive resistor 22 changes its resistance value. So that the optical body 23 evaluates the brightness of the whole area 28 to be monitored for the purposes of an integrated measured brightness value and a situation is avoided where the optical body 23 merely evaluates the portion of space located directly underneath the tip 27, the lower tip 27 of the optical body 23 is blacked out in that, for example, the tip 27 has a patch that is impervious to light adhered to it.

It can be seen from FIG. 1 that by screwing the body 23 that is pervious to light in or out in relation to the housing 21 which is impervious to light the surface of the optical body 23 that is active in detecting the ambient light can be varied in a simple manner. In particular, the distance between the light-sensitive resistor 22 and the lens 26 of the optical body 23 is changed, whereby the intensity of light of the irradiated light cast by the lens 26 on the light-sensitive resistor 22 is also changed. Thus the actual brightness value measured by the light sensor 20 can be changed immediately. The actual brightness value of the monitored area 28 delivered by the light sensor 20 is supplied to an electronic ballast EVG, in which case as a function of the actual brightness value supplied a control arrangement 12 dims a lamp which is used to illuminate a workplace 29 provided in the space 28 being monitored.

Of course, instead of using the light-sensitive resistor 22 it is also possible to use another light-sensitive component, for example a photodiode, which as a function of the incident light outputs a corresponding signal or changes its physical property. Likewise, the light-sensitive resistor 22 can also be provided with a thread so that the position both of the optical body 23 and of the light-sensitive resistor 22 can be changed within the housing 21.

Figure 2:
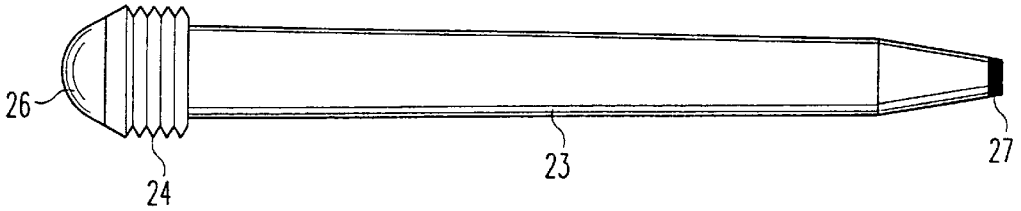
FIG. 2 shows a side view of the light sensor shown in FIG. 1.

FIG. 2 shows a side view of the optical body 23 of the light sensor 20 which is shown in FIG. 1. In particular, the conical shape of the optical body 23 directed towards the tip 27 can be seen in FIG. 2. Furthermore, the blacked-out portion of the tip 27 can be seen in FIG. 2.

Figure 3:
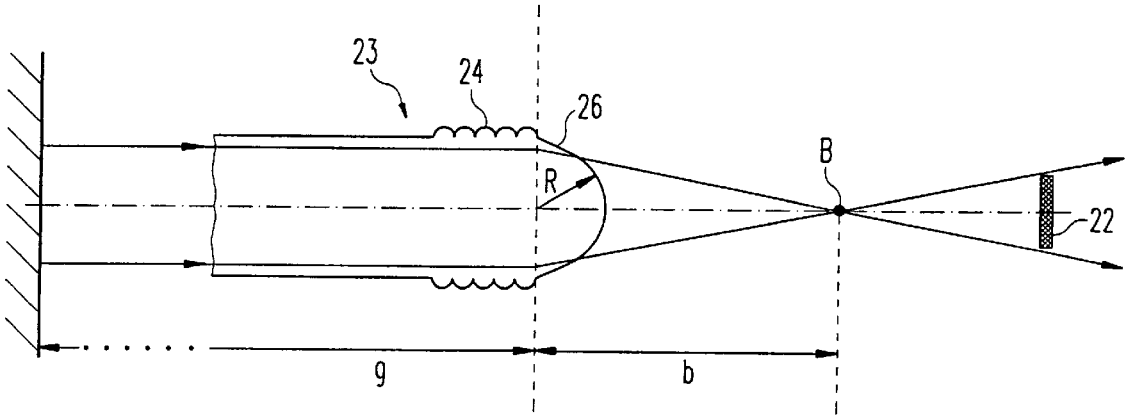
FIG. 3 is a diagrammatic representation for the purpose of illustrating the spatial arrangement of a lens provided in the light sensor shown in FIGS. 1 and 2 in relation to a light-sensitive resistor which is provided in the light sensor.

FIG. 3 shows a diagrammatic representation of the optical body 23 in relation to the light-sensitive resistor 23 within the housing 21 which is shown in FIG. 1. The luminous radiation detected by the optical body 23 within the monitoring space 28 shown in FIG. 1 is guided within the optical body 23, which is pervious to light, to the convexly shaped end 26 and is concentrated there. The following relationship then exists:

$$1/g+1/b=(n-1)/R,$$

where g denotes the so-called object distance, that is, the distance between the optically active surface of the lens 26 and the object being monitored, b denotes the so-called image distance, that is, the distance between the optically active surface of the lens 26 and the focal point B of the lens 26, n denotes the refractive index of the material of the lens 26 and R denotes the radius of curvature of the convexly shaped lens 26.

When rays arrive at the lens 26 in parallel, the object distance g is regarded as being infinite so that $$b=R/(n-1)$$

holds good.

It can be seen from FIG. 3 that the light-sensitive resistor 22 must be arranged at an appropriate distance away from the lens 26, by at least the image distance b. If polycarbonate (n=1.58) is used, for example, as the material for the lens 26 and the radius R of the lens 26 amounts to, for example, 3.5 mm, the light-sensitive resistor 22 must be at least 6.0 mm away from the convexly shaped lens 26. If plexiglass (n=1.49) is used as the material of the lens 26, for the same lens radius R=3.5 mm a minimum distance of b=7.1 mm results. In practice, however, a greater distance than that specified by the image distance b is required since the light-sensitive resistor 22 does not have a punctiform active surface which can come to lie at the focal point B, but has, for example, an active surface which is 4 mm×4 mm.

If the sensitivity of the light sensor in accordance with the invention to rotation of the optical body 23 within the housing 21 shown in FIG. 1 is too great, the radius of curvature of the lens 26 is to be increased.

The light sensor directly activates the electronic ballast EVG in accordance with the invention that is shown in FIG. 1 and which as a function of the actual brightness value detected by means of the light sensor 20 dims a lamp provided for the purpose of illuminating the area 28. To this end, the electronic ballast EVG has a control arrangement 12 which can be formed in particular by means of a microprocessor. Since the microprocessor operates digitally, the analog signal delivered by the light sensor 20 must be converted into a digital signal. For this purpose, the electronic ballast contains an analog-to-digital converter circuit arrangement which is connected upstream of the control arrangement 12 and which in particular comprises two resistors 13 and 14 and also a capacitor 15. The light sensor 20 in accordance with the invention is connected to two terminals 18*a* and 18*b* of the electronic ballast. One resistor 13 is connected between the first terminal 18*a* and a first input 16*a* of the control arrangement 12. The other resistor 14 is connected between the second terminal 18*b* and a second input 16*b* of the control arrangement 12, with the capacitor 15 being connected to the point of connection between the resistor 14 and the second terminal 18*b* and also to earth.

The function of the analog-to-digital converter circuit arrangement in accordance with the invention with the resistors 13 and 14 and also the capacitor 15 is explained in the following with reference to FIG. 6. The control arrangement 12 can switch its inputs 16*a* and 16*b* so that they are alternately of high or low resistance. In order to convert the analog actual brightness value signal delivered by the light sensor 20 into a digital signal which can be utilized by the control arrangement 12, the control arrangement 12 first applies a charging voltage, for example a voltage of 5V, by way of the resistor 14 to the capacitor 15. In this case, the input 16*b* is therefore of low resistance and the input 16*a* of high resistance. Subsequently, the input 16*b* is switched so as to be of high resistance and the input 16*a* is switched so as to be of low resistance so that the capacitor 15 can be discharged by way of the light sensor, which is connected to the terminals 18*a* and 18*b*, with the light-sensitive resistor and the resistor 13.

Figure 6:
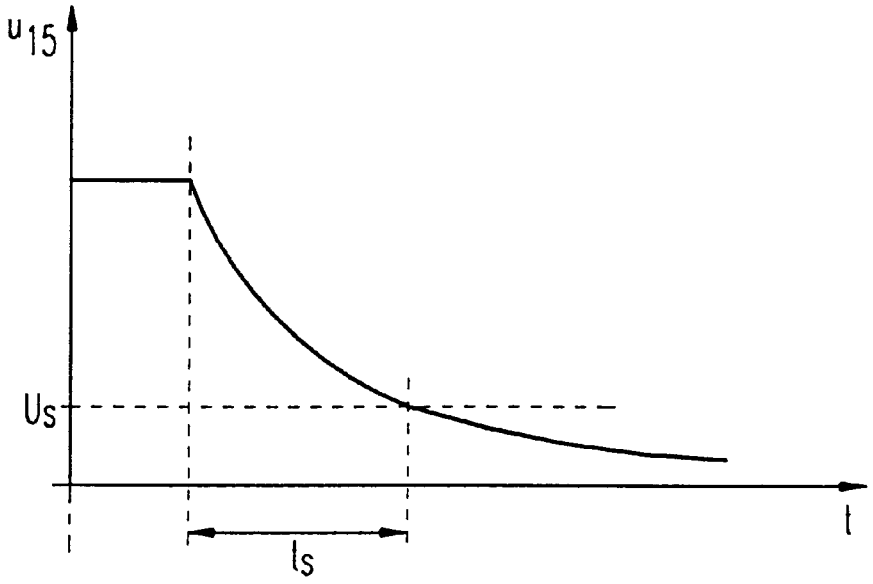
FIG. 6 shows the time characteristic of a voltage dropping across a capacitor that is provided in the electronic ballast in accordance with the invention for the purpose of explaining the method, in accordance with the invention, with which the analog actual brightness value delivered by the light sensor in accordance with the invention is converted into a digital actual brightness value.

The voltage $u_{15}$ occurring at the capacitor 15 then has the time characteristic which is shown in FIG. 6. In particular, the voltage $u_{15}$ drops exponentially over time, in which case the control arrangement 12 measures the time interval $t_S$ that is required until the voltage $u_{15}$ applied to the capacitor 15 has reached a given threshold value $U_S$.

The control arrangement 12 compares the measured value of the subinterval $t_S$ with a given desired value $t_{soll}$ and as a function of the result of comparison produces a manipulated-variable value for the brightness of the lamp(s) activated by the electronic ballast. This given desired value $t_{soll}$ can be permanently stored in the control arrangement 12. It is, however, also possible to supply this desired value $t_{soll}$ to the control arrangement 12 externally by way of an interface, in particular a serial interface, as control information pertaining to a dimmer. To this end, the control arrangement 12 has inputs 17*a* and 17*b* which are connected to terminals 19*a* and 19*b* of the electronic ballast EVG, which terminals are provided for the purpose of receiving external control information $I_{extern}$. If the control arrangement 12 also obtains external control information for the dimming, it is no longer necessary to change the brightness at the workplace 29 by rotating the optical body 23 in the light sensor 20, since the change in the actual brightness value can already be effected by means of an external dimmer which applies a corresponding desired dimming value within the external control information $I_{extern}$ to the control arrangement 12.

The electronic ballast EVG in accordance with the invention that is shown in FIG. 1 has—as has already been described—terminals 18*a* and 18*b* for the purposes of connection of the light sensor 20 in accordance with the invention. The electronic ballast when put into operation carries out a test to determine whether a light sensor 20 is connected or not. This test is carried out as follows:

After switching on a lamp that is activated by the electronic ballast EVG and which is provided to illuminate the area 28 monitored by the light sensor 20, the control arrangement 12 measures the resistance applied externally to the terminals 18*a* and 18*b*. If the light sensor 20 is connected, in this case the control arrangement 12 measures a specific finite resistance value, whilst in the absence of a light sensor 20, a resistance value which is almost infinite or very high is measured at the terminals 18*a* and 18*b*. By comparing the resistance value measured at the terminals 18*a* and 18*b* with a given limiting value, the control arrangement 12 can thus conclude whether a light sensor 20 is connected.

If the control arrangement 12 has identified that a light sensor 20 is connected, the control arrangement 12 uses the actual brightness value signals delivered by the light sensor 20 for the control of the lamp, which is provided in a corresponding manner to illuminate the area 28. If the control arrangement, on the other hand, has identified that no light sensor 20 is connected, the lamp is dimmed exclusively by way of external control information $I_{extern}$ which is supplied to the terminals 19*a* and 19*b* and can, for example, contain external dimming information or desired-value inputs pertaining to an external dimmer. Thus a conflict between the externally supplied control information $I_{extern}$ and actual brightness value signals of the light sensor 20 is avoided.

By way of the control line connected to the terminals 19*a* and 19*b* it is also possible for an off-command that switches off the electronic ballast to be supplied to the electronic ballast. If a dimming signal of the control arrangement 12 is supplied by way of this external control line, then—as already previously described—this dimming signal is ignored if the control arrangement has identified that a light sensor 20 is connected. If the electronic ballast is in a state of readiness, that is, a stand-by mode, in which the mains voltage is switched on, whilst the internal components of the electronic ballast are temporarily switched off, an external dimming command supplied by way of the terminals 19*a* and 19*b* is evaluated as an on-command by the control arrangement 12 which thereupon switches the internal components of the electronic ballast, in particular an inverter provided in the electronic ballast, back on, in which case no renewed examination of the terminals 20*a* and 20*b* is carried out to determine whether a light sensor 20 is connected. Thus an external dimming signal applied in the stand-by mode is detected as a signal to switch back on.

Figure 4:
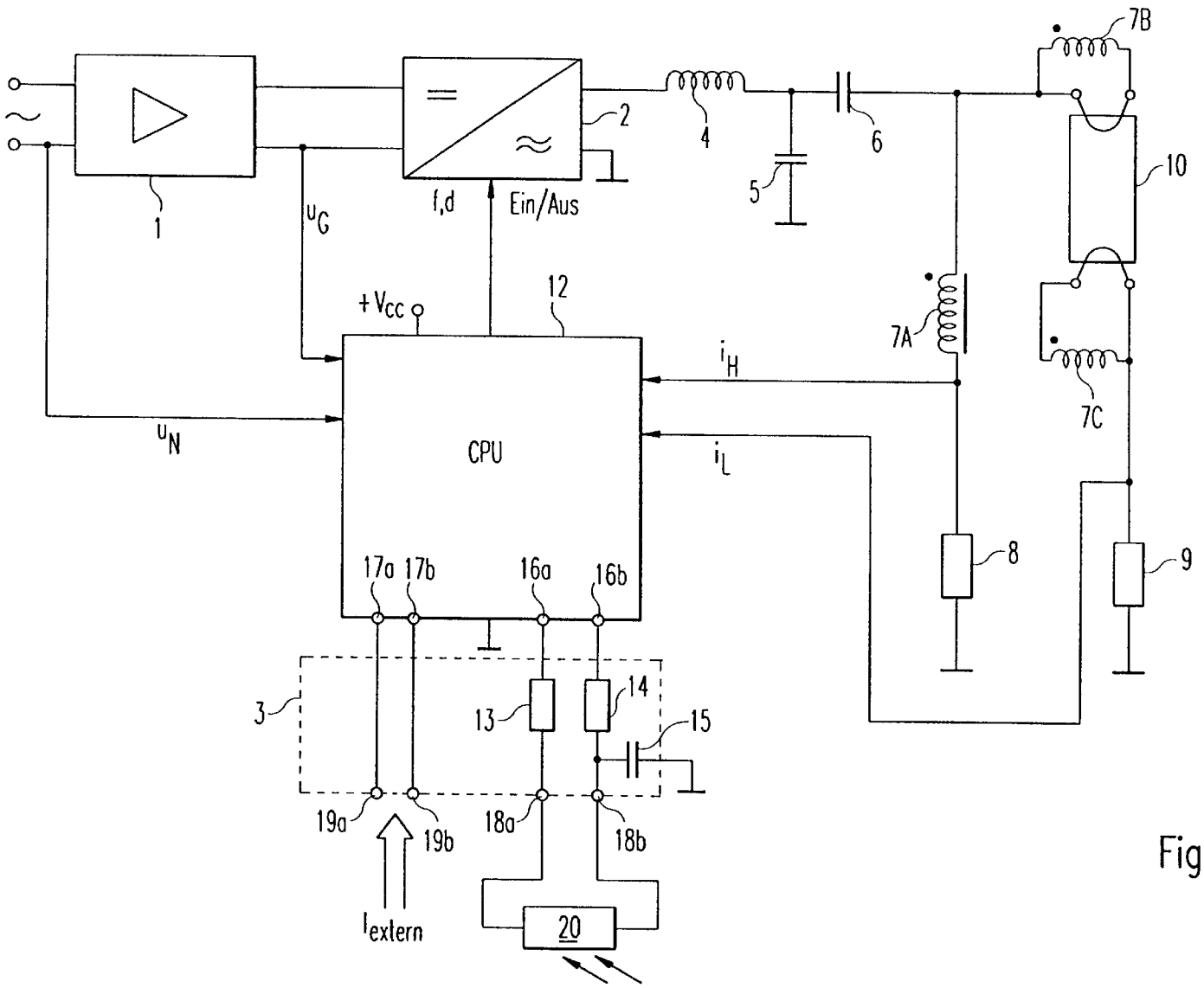
FIG. 4 is a block diagram of a preferred exemplary embodiment of the electronic ballast, in accordance with the invention, to which a light sensor is connected.
Figure 5:
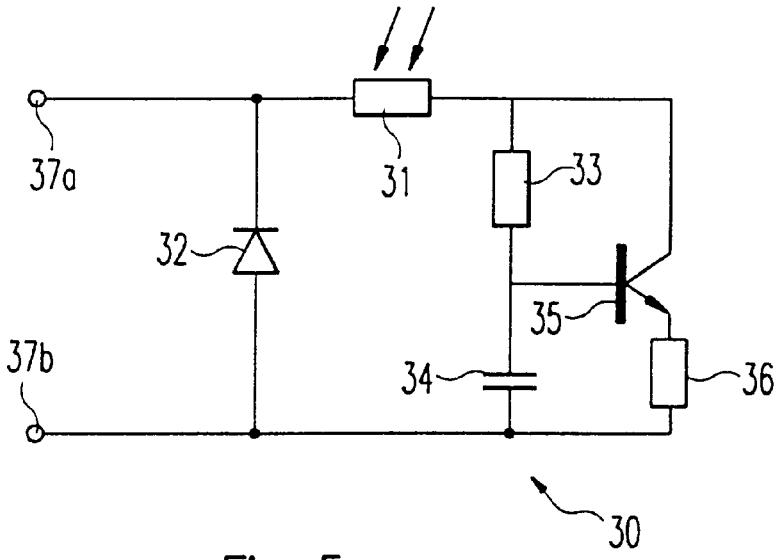
Fig. 5 (PRIOR ART)
FIG. 5 shows a circuit diagram of a known light sensor.

FIG. 4 shows the internal structure of the electronic ballast in accordance with the invention, where again a light sensor 20 is connected to the electronic ballast.

The electronic ballast shown in FIG. 4 is used in particular to operate at least one gas discharge lamp 10. The electronic ballast comprises a rectifier 1 which converts a mains voltage into a rectified intermediate-circuit voltage which in turn is applied to an inverter 2. The inverter 2 has, as a rule, two switches which are connected in series between a positive supply voltage and earth and which can be designed in particular as MOS field-effect transistors and are activated, that is, are closed and opened, alternately. In this way, the inverter 2 generates a high-frequency, clocked alternating voltage, the envelope curve of which follows the intermediate-circuit voltage delivered by the rectifier 1. Connected to the inverter 2 there is a load circuit which in particular has the gas discharge lamp 10 and also a series-resonant circuit with a coil 4 and a capacitor 5, with the gas discharge lamp 10 being connected to the series-resonant circuit by way of a coupling capacitor 6. The gas discharge lamp 10 is fired in that the frequency of the alternating voltage delivered by the inverter 2 is shifted into the proximity of the resonant frequency of the series-resonant circuit so that a voltage overshoot occurs at the capacitor 5 that results in the gas discharge lamp 10 being fired. In order to extend the life of the gas discharge lamp 10 it is expedient to pre-heat the lamp filaments before firing the gas discharge lamp 10. To this end, in accordance with FIG. 4 a filament transformer is provided, the primary winding 7A of which transformer is connected to the series-resonant circuit and the secondary windings 7B and 7C of which are each connected in parallel with one of the lamp filaments of the gas discharge lamp 10. During the pre-heating operation the gas discharge lamp is supplied with a filament voltage, the frequency of which lies below the resonant frequency of the series-resonant circuit. As a result of using a filament transformer, energy can also be supplied to the lamp filaments of the gas discharge lamp 10 after it has been fired.

Furthermore, the electronic ballast in accordance with the invention has a central control arrangement 12 which in particular can comprise a microprocessor. The control arrangement 12 is used in particular to regulate the brightness of the gas discharge lamp 10 as a function of an externally supplied actual brightness value which reproduces the brightness of the gas discharge lamp 10. To this end, the light sensor 20 is connected to the control arrangement 12 by way of a connection or interface arrangement 3 which at the same time can have the analog-to-digital converter circuit arrangement, which has already been described above, with the resistors 13 and 14 and the capacitor 15. Moreover, external control information $I_{extern}$, for example desired-value inputs pertaining to an external dimmer etc., can be supplied to the control arrangement 12 by way of the terminals 19*a* and 19*b* and the inputs 17*a* and 17*b* respectively of the control arrangement 12 in order to influence the adjustment of the brightness of the gas discharge lamp 10.

Advantageously, the control arrangement 12 for the control and regulation of the operational performance of the electronic ballast in accordance with the invention, in addition to taking external control information $I_{extern}$ into account, also takes internal operating-status information into account. Thus in accordance with FIG. 4 it is provided that actual values of the mains voltage $u_N$, the rectified intermediate-circuit voltage $u_G$, the lamp current $i_L$ flowing by way of the gas discharge path of the gas discharge lamp 10 and also the filament current $i_H$ be fed to the control arrangement 12 as well. For the purpose of detecting the lamp current $i_L$, connected in series with the gas discharge lamp 10 there is a resistor 9 so that the voltage dropping across this resistor 9 represents a measure of the lamp current $i_L$ flowing by way of the gas discharge path of the gas discharge lamp 10. In order to detect the filament current $i_H$ flowing by way of the primary winding 7A of the filament transformer, a resistor 8 is connected in series with the primary winding 7A in a similar manner so that the voltage dropping across this resistor 8 represents a measure of the filament current $i_H$. In this way, it is possible for the control arrangement 12 not only to dim the gas discharge lamp 10 as a function of the actual-value signals, delivered by the light sensor 20, and the external control information $I_{extern}$ respectively, but, as a result of monitoring the internal operating-status parameters also to establish cases of fault within the electronic ballast, such as, for example, an excessive lamp current, a filament current that is too low or the occurrence of the so-called rectifier effect within the gas discharge lamp 10, and to take corresponding measures, for example, by switching the inverter 2 on and off.

Generally, the gas discharge lamp 10 is dimmed as a function of the actual brightness values delivered by the light sensor 20 in accordance with the invention by varying the frequency f and/or the pulse duty factor d of the clocked alternating voltage delivered by the inverter 2. In this connection, advantageously after switching on the electronic ballast in the first instance the connected gas discharge lamp is operated at full luminous power, that is, with maximum brightness, so that subsequently—if a light sensor 20 is connected—the lamp 10 can be dimmed by the light sensor 20, that is, its brightness can be regulated.

Figure 7:
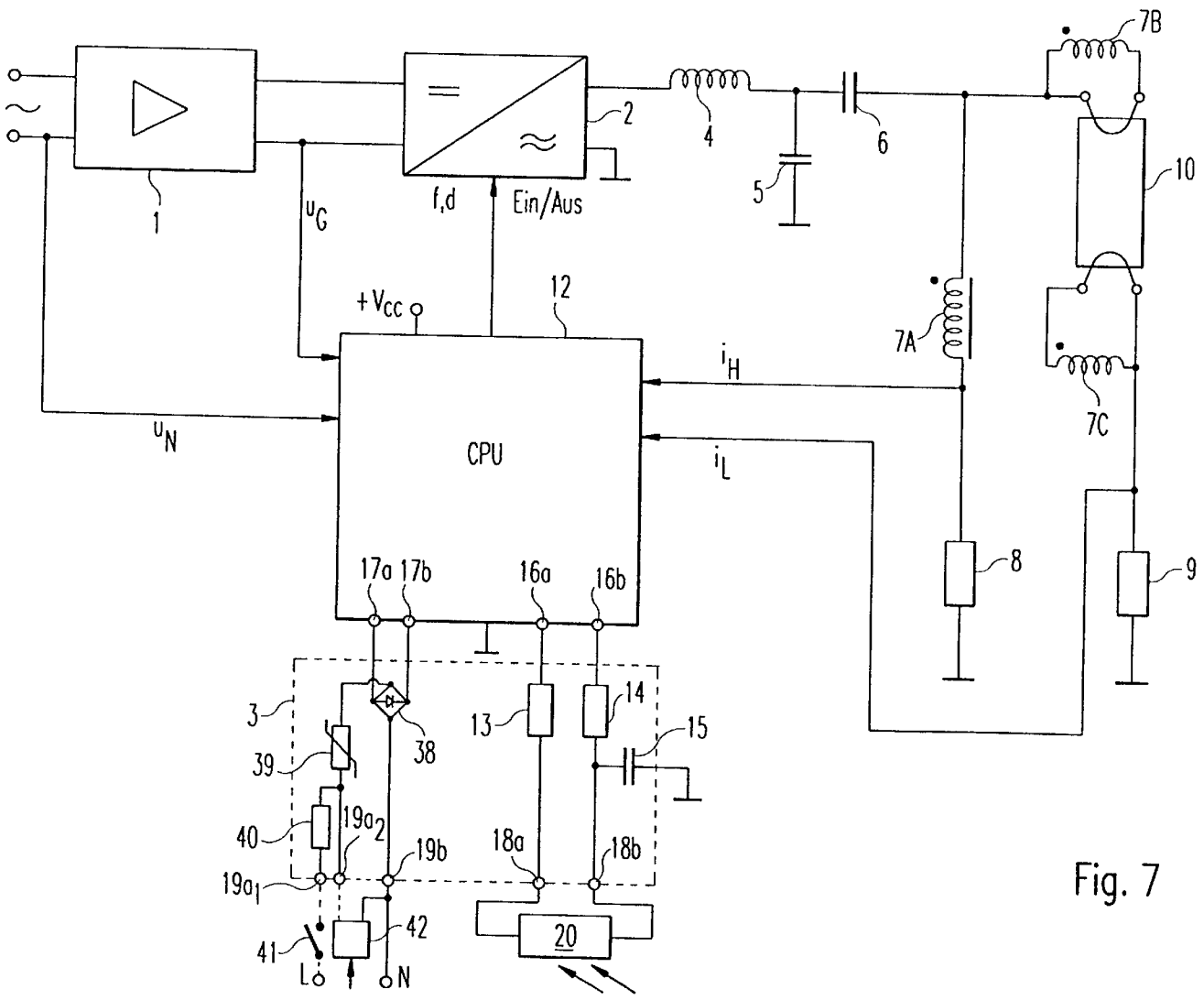
FIG. 7 shows a block circuit diagram of a further preferred exemplary embodiment of the electronic ballast in accordance with the invention.

FIG. 7 shows a further preferred exemplary embodiment of the electronic ballast in accordance with the invention. The design and the function of this exemplary embodiment substantially correspond to the design and function of the exemplary embodiment shown in FIG. 4. What is particularly advantageous, however, in the case of the exemplary embodiment shown in FIG. 7 is the configuration of the interface arrangement 3. The configuration of the interface arrangement 3 shown in FIG. 7 makes it possible to activate the electronic ballast with the aid of external control information, for example, both by way of a switch or key button 41 and by way of digital control signals of a digital serial interface (DSI) 42. In this connection, the control arrangement 12, with the aid of the signal structure of the signals fed to it, identifies whether key-button signals (that is, simple pulse signals) or DSI-signals (that is, signals according to a digital protocol) are present. The external control information is processed differently by the control arrangement as a function of this identification.

The special configuration of the interface arrangement 3 is not limited to applications in the case of electronic ballasts in accordance with the invention, but in principle can be used in the case of all electronic ballasts that are to be activated both by way of key-button signals and by way of digital control signals.

The interface arrangement 3, which is shown in FIG. 7, is set up in a simple manner. The one terminal 19*a* shown in FIG. 4 for the reception of the external control information $I_{extern}$ is split into two terminals 19$a_1$ and 19$a_2$. It is possible for a switch or key button 41 to be connected to the first terminal 19$a_1$, whilst the second terminal 19$a_2$ can be connected to a digital serial interface 42. Connected to a third terminal 19*b* of the interface arrangement 3 there is an earth conductor or a neutral conductor N both for the key-button operation and for the DSI operation. As a function of whether the control arrangement 12 is to be activated with the aid of key-button signals or DSI signals, the corresponding terminal 19$a_1$ or 19$a_2$ respectively is used, whilst the other terminal 19$a_2$ or 19$a_1$ respectively remains free. The terminals 19$a_1$ and 19$a_2$ are connected together in the interface arrangement 12 by way of a series resistor 40 and together are connected by way of an overvoltage protection element 39 to a rectifier circuit arrangement 38, the other input terminal of which is connected to the third terminal 19*b* of the interface arrangement 3. On the output side the rectifier circuit arrangement 38 is connected to the inputs 17*a* and 17*b* of the control arrangement 12 and is used as polarity reversal protection in respect of the terminals 19$a_1$ and 19$a_2$, on the one hand, and also 19*b*, on the other hand.

If a key button 41 is connected, the electronic ballast is switched on or off by means of (short or long) depression of the key button. If the control arrangement 12 has identified that a light sensor 20 is connected to the electronic ballast, the brightness of the lamp 10 is regulated as a function of the actual brightness value of the light sensor 20. By depressing the key button 41 merely the desired value for the regulation of the brightness can be changed in order to obtain therefore in an indirect manner a change in the brightness of the lamp 10. If a DSI 42 is connected and the control arrangement 12 has identified that a light sensor 20 is connected, as a rule merely one digital on/off-command of the DSI 42 is processed by the control arrangement 12. On the other hand, manipulated-variable dimming values, that is, inputs such as, for example, "dimming to 50%", are ignored by the control arrangement 12. Analogously to the key-button operation, however, it is also conceivable with respect to the DSI-operation to input or adjust the desired value for the regulation of the brightness by the control arrangement 12 by means of certain digital commands. After identifying that a light sensor 20 is connected, however, the brightness is always regulated as a function of the actual brightness value of the light sensor 20.

If, on the other hand, no light sensor 20 is connected, the electronic ballast controls the brightness of the lamp exclusively as a function of the externally supplied control information $I_{extern}$. When a key button 41 is connected, for example, the lamp 10 can be adjusted so as to be brighter or darker as a function of the duration of the depression of the key button, in which case, for example, each second depression of the key-button changes the direction in which dimming is effected. When a DSI is connected, on the other hand, the control arrangement controls the operation of the electronic ballast simply by converting the digital control commands, such as, for example "on/off", "dimming to x % brightness", "start of the dimming operation" or "termination of the dimming operation" and so on.

What is claimed is:

1. In combination with an electronic ballast for operating at least one lamp, having a connection arrangement, to which a light sensor can be connected for the purpose of monitoring the brightness of a specific physical area;

a control arrangement which controls or regulates the brightness of said at least one lamp as a function of an actual brightness value received from a light sensor, said control arrangement being responsive to said electronic ballast being put into operation to indicate whether the light sensor is connected to the connection arrangement.

2. A combination according to claim 1, further including:

an analog-to-digital converter connected between the connection arrangement and the control arrangement to convert the analog actual brightness value received from the light sensor into a digital actual brightness value.

3. A combination ballast according to claim 2, wherein:

said analog-to-digital converter comprises a resistor-capacitor circuit arrangement.

4. A combination according to claim 2, wherein:

the connection arrangement has a first terminal and a second terminal; and the control arrangement has a first input and a second input, said analog-to-digital converter including:

a first resistor connected between the first terminal of the connection arrangement and the first input of the control arrangement;

a second resistor connected between the second terminal of the connection arrangement and the second input of the control arrangement; and a capacitor connected between the second terminal and ground.

5. A combination according to claim 4, wherein:

the two inputs of the control arrangement are switchable to provide alternate high and low resistances; and wherein the control arrangement for determining the digital actual brightness value as a function of the analog actual brightness value of the light sensor is arranged to first switch the first input so that it provides high resistance and by way of the second resistor charges the capacitor with a voltage and subsequently to switch the first input so that it is of low resistance and the second input so that it is of high resistance so that the capacitor can be discharged by way of a light sensor, connected to the connection arrangement, and the first resistor.

6. A combination according to claim 5, wherein:

the control arrangement is constructed to compare the time interval between the beginning of the discharge of the capacitor of the analog-to-digital converter arrangement and the time at which the voltage applied to the capacitor drops to a given threshold value with a given reference time value and, as a function of the result of comparison, to produce a manipulated-variable value for controlling brightness of said at least one lamp.

7. A combination according to claim 6, wherein:

said given reference time value and/or threshold value is stored in the control arrangement.

8. A combination according to claim 6, further including:

means for feeding said given reference time value and/or threshold value to the control arrangement.

9. A combination according to claim 1, wherein:

the control arrangement comprises a microprocessor.

10. A combination according to claim 1, wherein:

said control arrangement, in addition to being connected to receive the digital actual brightness value of the light sensor from said analog-to-digital converter arrangement, is also arranged to receive internal operating-status information of the electronic ballast and, as a function thereof, to produce a manipulated-variable value for a manipulated variable of the electronic ballast for the purpose of adjusting the brightness of the at least one lamp.

11. A combination according to claim 1, wherein:

the control arrangement is connected to ascertain whether a light sensor is connected by measuring a resistance value applied to the connection arrangement and comparing the measured resistance value with a given reference resistance value and, if the measured resistance value does not exceed the given reference resistance value, to indicate that a light sensor is connected.

12. A combination according to claim 11, wherein:

the control arrangement is arranged to measure the resistance value applied to the connection arrangement after switching on the lamp to illuminate a physical area being monitored by the light sensor.

13. A combination according to claim 1, and further including:

an interface arrangement connected to receive externally supplied control information for controlling the operation of the electronic ballast.

14. A combination according to claim 13, wherein:

the interface arrangement includes terminals which are connected terminals which are connected to receive switching signals which occur as external control information in consequence of actuation of a switch and/or in consequence of the occurrence of digital control signals.

15. A combination according to claim 14, wherein:

the interface arrangement has a first terminal for selectively connecting the switch, a second terminal for selectively connecting a device that delivers the digital control signals and a third terminal for the connection of a ground line.

16. A combination according to claim 15, wherein:

the first terminal and the second terminal, on the one hand, and also the third terminal on the other hand, are connected to a rectifier circuit arrangement which in turn is connected to the control arrangement.

17. A combination according to claim 14, wherein:

the control arrangement is constructed such that by evaluating the signal applied to the terminals of the interface arrangement, the control arrangement identifies whether the external control information is present in the form of switching signals or in the form of digital signals, said control arrangement being constructed to process the external control information differently as a function of whether the external control information is identified as being present in the form of switching signals or in the form of digital signals.

18. A combination according to claim 13, wherein:

the control arrangement is constructed such that, after identifying that a light sensor is connected, it ignores any dimming signal contained in the externally supplied control information and identifies the connected light sensor as an actual brightness value sensor.

19. A combination according to claim 18, wherein:

the control arrangement is constructed such that, after identifying that a light sensor is connected, it processes only on/off-commands or desired-value inputs contained in the externally supplied control information and thereby regulates the brightness as a function of the actual brightness value of the light sensor.

20. A combination according to claim 13, wherein:

the control arrangement is constructed such that if no light sensor is connected, the control arrangement controls or regulates the brightness of the at least one lamp in accordance with the externally supplied control information.

21. A combination according to claim 13, wherein:

the control arrangement is constructed such that, if the electronic ballast is in a stand-by mode, the control arrangement puts the electronic ballast back into operation if a dimming signal is contained in the supplied external control information.

22. A combination according to claim 21, wherein:

the control arrangement is constructed such that after a stand-by mode of operation of the electronic ballast, the control arrangement puts the electronic ballast back into operation without renewed examination to determine whether a light sensor is connected to the connection arrangement.

23. A combination according to claim 1, wherein:

the control arrangement is constructed such that after the electronic ballast has been put into operation, the control arrangement sets the at least one lamp to a maximum brightness value.

24. A combination according to claim 1, and further including:

a light sensor connected to the connection arrangement, said light sensor comprising:

an optical light-detection means arranged to detect luminous radiation that corresponds to the brightness of a monitored area; and a light-sensitive means located so as to be irradiated by the luminous radiation which is detected by the optical light-detection means and, as a function of the incident luminous radiation, to emit a corresponding signal or to change their physical properties, the distance between the optical light-detection means and the light-sensitive means being variable.

25. A combination according to claim 24, wherein:

the light-sensitive means comprises a light-sensitive resistor positioned to be irradiated by the detected luminous radiation, the electrical resistance value of said light-sensitive resistor being variable as a function of the incident luminous radiation.

26. A combination according to claim 24, wherein:

the optical light-detection means and the light-sensitive means are arranged in a housing which has a first screw thread which is formed in accordance with a second screw thread provided on the optical light-detection means and/or the light-sensitive means so that the distance between the optical light-detection means and the light-sensitive means can be varied by adjusting the optical light-detection means and/or the light-sensitive means in relation to the housing with the aid of the first and the second screw threads.

27. A combination according to claim 26, wherein:

the first screw thread is arranged on the inside of the housing and in that the second screw thread is arranged on the outside of the optical light-detection means and/or the light-sensitive means.

28. A combination according to claim 24, wherein:

the housing is made of a material that is impervious to light.

29. A combination according to claim 24, wherein:

the optical light-detection means comprises an elongated light-guide arrangement with a lens, which has a convex surface facing the light-sensitive means.

30. A combination according to claim 29, wherein:

the light-guide arrangement extends conically towards an end thereof that is remote from the light-sensitive means.

31. A combination according to claim 29, wherein:

the end of the light-guide arrangement that is remote from the light-sensitive means is masked so as to be impervious to light.

32. A combination according to claim 29, wherein:

the light-guide arrangement is made of transparent plexiglass or polycarbonate.

33. A combination according to claim 29, wherein:

the distance between the lens of the optical light-detection means and the light-sensitive means is selected so as to be such that the focal point of the convex lens lies between the lens and the light-sensitive means.

34. A combination according to claim 33, wherein the distance between the lens and the optical light-detection means corresponds at least to the value $R/(n-1)$, where R corresponds to the radius of curvature of the lens and n corresponds to the refractive index of the lens material.

* * * * *